United States Patent [19]

Stockwell

[11] Patent Number: 4,475,292

[45] Date of Patent: Oct. 9, 1984

[54] SEPARATION

[75] Inventor: Claude L. Stockwell, Newbury, England

[73] Assignee: Secretary of State for United Kingdom Atomic Energy Authority, London, England

[21] Appl. No.: 330,697

[22] Filed: Dec. 14, 1981

[30] Foreign Application Priority Data

Dec. 19, 1980 [GB] United Kingdom ..... 8040711

[51] Int. Cl.[3] ..... F26B 3/16; F26B 17/14

[52] U.S. Cl. ..... 34/10; 34/33; 34/57 A; 34/168; 34/242; 159/DIG. 3

[58] Field of Search ..... 110/221, 224, 245; 159/4 E, 4 ST, 16 R, DIG. 3, DIG. 21, DIG. 29; 34/10, 57 A, 57 R, 168, 169, 33, 242

[56] References Cited

U.S. PATENT DOCUMENTS 3,092,471 6/1963 Stromeyer ..... 34/57 A
3,305,939 2/1967 Sonnenschein et al. ..... 34/168
4,330,502 5/1982 Engstrom ..... 34/57 A

FOREIGN PATENT DOCUMENTS 1363532 8/1974 United Kingdom .

*Primary Examiner*—Larry I. Schwartz
*Attorney, Agent, or Firm*—Larson and Taylor

[57] ABSTRACT

The present invention relates to separation and finds application in the removal of liquid from particulate material having associated liquid.

The invention provides a process and apparatus for the removal of liquid from a particulate material having associated liquid.

In accordance with the invention gas is passed through a bed of particulate material having associated liquid, gas which has thereby taken up liquid is removed from the bed and the particulate material is then removed from the bed via an outlet while resistance to gas flow through the outlet is provided to encourage gas to pass through the bed rather than through the outlet.

15 Claims, 4 Drawing Figures

SEPARATION

Figure 1:
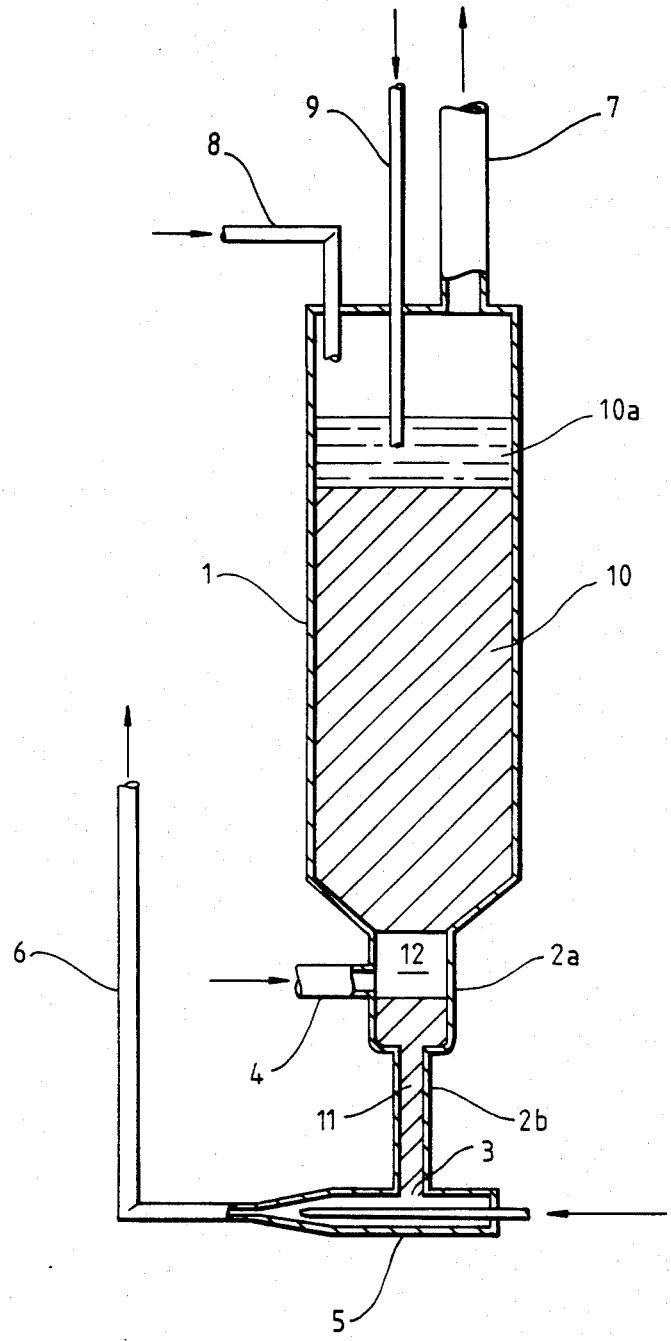

The present invention relates to separation and finds application in the removal of liquid from a particulate material having associated liquid.

According to one aspect of the present invention there is provided a process for the removal of a liquid from a particulate material having associated liquid which comprises forming a bed containing particulate material and associated liquid, passing gas through the bed to take up liquid from the bed into the gas, removing gas and liquid taken up in the gas from the bed, withdrawing particulate material, from which liquid has been removed, from the bed via an outlet, and providing resistance to gas flow through the outlet so as to encourage gas to pass through the bed rather than through the outlet.

According to another aspect of the present invention there is provided apparatus for removing a liquid from particulate material having associated liquid comprising a vessel for containing a bed of particulate material and associated liquid, means for passing gas through such a bed when contained in the vessel such that liquid is taken up from the bed into the gas, means for removing gas and liquid taken up by the gas from the vessel, an outlet for withdrawing particulate material, from which liquid has been removed, from the vessel and means for providing resistance to gas flow through the outlet so as to encourage gas to pass through the bed rather than through the outlet.

The bed may be, for example, a packed bed or a fluidised bed.

The particulate material having associated liquid may be, for example, a slurry comprising substantially spherical particles. The substantially spherical particles may be, for example, particles produced by a gel precipitation process (e.g. particles for use in the nuclear industry and containing one or more of the following: uranium, plutonium and thorium). The associated liquid may be, for example, an agent used for drying gel particles (e.g. hexanol). Reference may be made to the following UKAEA British Patent Specifications Numbers for details of gel precipitation processes: Nos. 1175834, 1231385, 1253807, 1313750 and 1363532.

Many gases are suitable for use in accordance with the present invention (e.g..air or nitrogen). The gas is preferably at a temperature higher than ambient temperature and by way of example 65° C. has been found to be convenient.

In a preferred embodiment of the present invention the resistance to gas flow through the outlet may be provided by a bed of particulate material positioned between the vessel and the outlet.

Thus, for example, particulate material from which liquid has been removed in the vessel may be arranged to fall into a region below an inlet for the gas and form, in this region, a packed bed thereby to provide resistance to gas flow through the outlet and encourage gas to pass through a bed in the vessel rather than through the outlet.

Alternatively, for example, particulate material from which liquid has been removed may pass through the outlet and be transported (e.g. by gas ejector) to a further vessel to form a second bed thereby to provide the resistance to gas flow through the outlet.

The liquid may be associated with the particulate material for example by being present in interstitial spaces between particles and/or where the particulate material is porous by being contained in the particulate material.

It will be appreciated that without the provision of resistance in accordance with the present invention gas would tend to flow through the outlet and hence the amount of gas passing through the bed of particulate material having associated liquid would be reduced.

It will also be appreciated that with solid/gas systems it is not possible to provide the resistance by use of a pressure head as it is with a solid/liquid system where a 'stand pipe' arrangement can be used to provide back pressure. The present invention may be used substantially to overcome this problem in solid/gas systems.

Figure 1A:
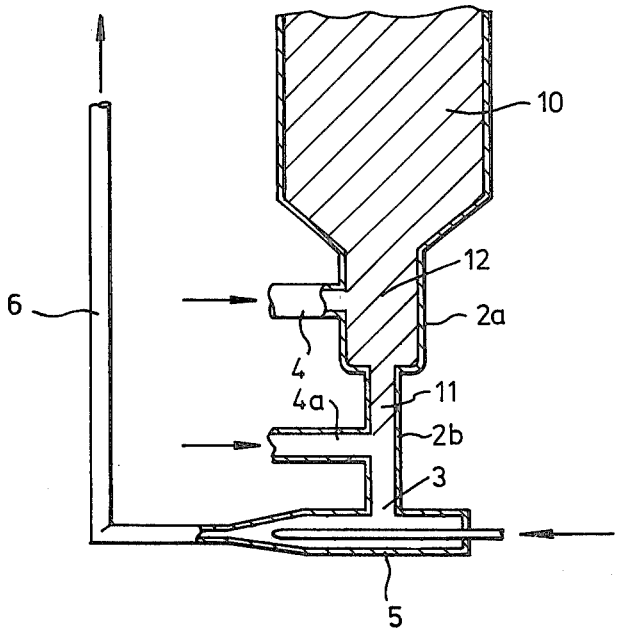
Figure 2:
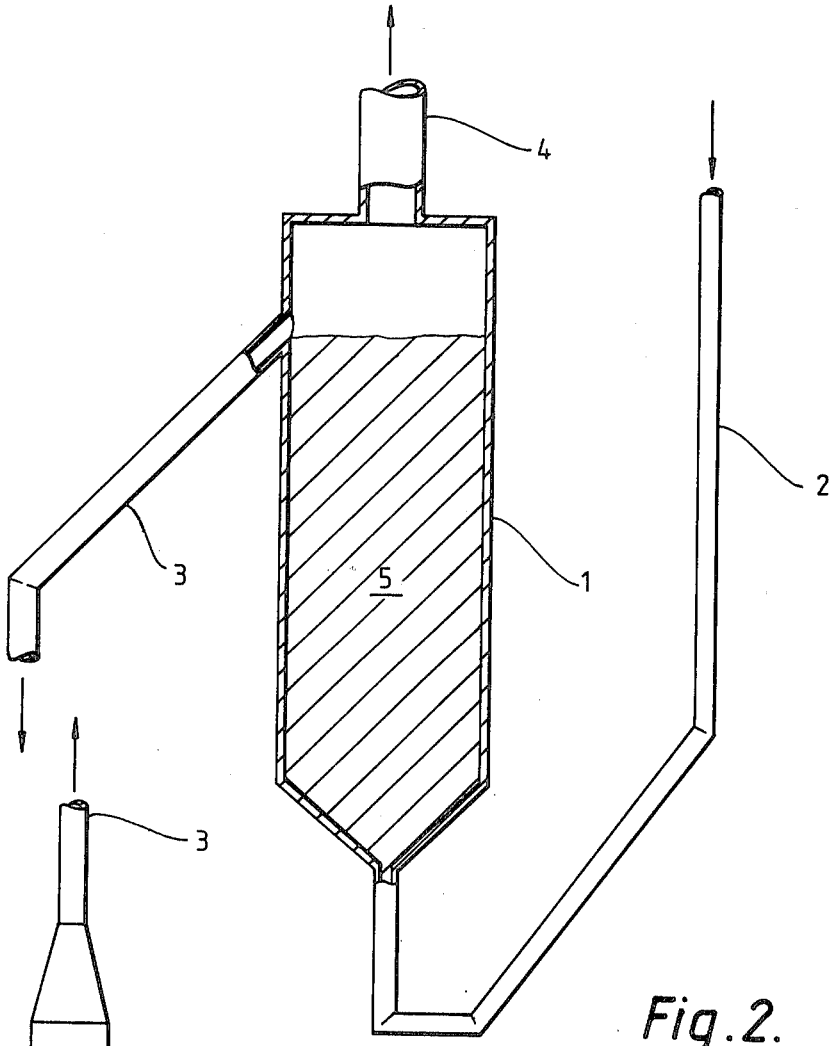
Figure 3:
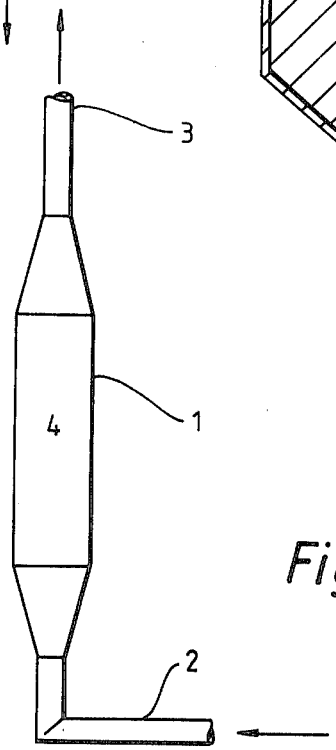

The invention will now be further described, by way of example only, with reference to the accompanying drawings in which:

FIG. 1 is a diagrammatic representation of an apparatus for removing liquid from particulate material having associated liquid, FIG. 1*a* is a diagrammatic representation of an optional modification of the apparatus shown in FIG. 1, and FIGS. 2 and 3 show alternative means for providing resistance to gas flow.

Referring now to FIG. 1 of the Drawing there is shown an apparatus having a column 1 provided with smaller diameter portions 2*a* and 2*b* and an outlet 3. The portion 2*a* is provided with a gas inlet 4 and the outlet 3 connects with a gas driven ejector pump 5 by means of which, in operation, particulate material can be discharged through line 6.

The column 1 is provided also with a gas outlet 7, a feed inlet 8 and an additional gas inlet 9.

In operation the column 1 is arranged vertically with the portions 2*a* and 2*b* below.

A slurry of particulate material having associated liquid is introduced through the feed inlet 8 and gas is introduced via the gas inlet 4. A bed forms in a region 10 and subsequently particulate material from which liquid has been removed passes downwardly to form a packed bed in region 11.

The packed bed provides resistance to gas flow through the outlet 3 and encourages gas to pass upwardly through the region 10 thereby to remove liquid from particulate material therein.

The gas bearing vapour from the liquid and/or entrained liquid leaves via the gas outlet 7.

Liquid can be recovered from the gas and the gas recycled to effect further liquid removal.

Particulate material from the bed in region 11 is discharged through the line 6 by means of the ejector pump 5 and further particulate material passes downwardly from the region 10 to maintain the packed bed in region 11.

It is to be understood that were it not for the resistance provided by the packed bed in region 11 gas introduced via gas inlet 4 would tend to pass out of the apparatus via the outlet 3 and the ejector pump 5 rather than passing upwards and removing liquid from the particulate material having associated liquid in region 10.

The particulate material in region 12 is present as an expanded bed.

To avoid the necessity of fluidising the entire bed in region 10 (and thereby reduce the gas supply requirements) whilst substantially avoiding flooding of the bed by free solvent, extra gas may be introduced through additional gas inlet 9 so as to form a fluidised bed in region 10*a* only. Thus a relatively large amount of gas can be used for the initial treatment of particulate material having associated liquid as it is introduced through the feed inlet 8.

Particulate material may be discharged through line 6 to a cyclone separator (not shown), for example, whereby particulate material can be recovered as product.

It will be appreciated that the gas and particulate material pass counter-currently in the operation of the apparatus of FIG. 1 and also that the dimensions of the column 1 are selected to give the particulate material residence time appropriate to the degree of liquid removal required.

Referring now to FIG. 1*a* there is shown an optional modification of the apparatus shown in FIG. 1 in which modification there is provided in the portion 2*b* a further gas inlet 4*a* to assist in start-up of the apparatus.

In operation, to start-up from empty, a slurry of particulate material having associated liquid is introduced through the feed inlet 8 (shown in FIG. 1) and gas is introduced through further gas inlet 4*a* at a flow rate sufficient to prevent particulate material from falling straight through outlet 3 into the ejector pump 5. Consequently a bed forms in regions 11, 12 and 10 and when a suitable bed level for operation has been reached introduction of gas through further gas inlet 4*a* is stopped and gas is introduced via gas inlet 4 whereafter operation is as hereinbefore described with reference to FIG. 1.

Referring now to FIG. 2 of the drawings there is shown an alternative means for providing resistance in accordance with the present invention. There is shown a column 1 having a feed pipe 2 a product outlet 3 and a gas outlet 4.

In operation particulate material having associated liquid is treated to remove liquid in an apparatus similar to that of FIG. 1 with the exception that no packed bed is provided above the gas driven ejector pump (5 of FIG. 1). Instead the ejector pump feeds particulate material from which liquid has been removed to column 1 (FIG. 2) through feed pipe 2 whereby a packed bed is formed in region 5. This packed bed provides resistance in accordance with the present invention so that in the liquid removal apparatus from which particulate material is fed to feed pipe 2 gas for removing liquid is encouraged to pass through the bed of particulate material having associated liquid rather than through the outlet.

As particulate material is added to the bed in region 5 by means of feed pipe 2 particulate material passes out from the top of the bed via product outlet 3. Gas leaves the column 1 via the gas outlet 4.

A cyclone separator is not required.

The dimensions of column 1, particularly the positioning of product outlet 3, are chosen such that in operation the depth of bed in region 5 provides the required resistance.

It is to be appreciated that where particulate material fed through feed pipe 2 still has some associate liquid, then further liquid may be removed from the particulate material whilst it is present in the region 5.

Referring now to FIG. 3 of the drawings there is shown a vessel 1 having an inlet pipe 2 and an outlet pipe 3.

In operation particulate material having associated liquid is treated to remove liquid in an apparatus similar to that of FIG. 1 with the exception that no packed bed is provided above the gas driven ejector pump (5 of FIG. 1).

Instead the ejector pump feeds particulate material from which liquid has been removed to vessel 1 via inlet pipe 2 whereby a bed forms in region 4.

This bed provides resistance in accordance with the present invention so that in the liquid removal apparatus from which particulate matter is fed to inlet pipe 2 gas for removing liquid is encouraged to pass through the bed of particulate material having associated liquid rather than through the outlet.

As particulate material is added to the region 4 via inlet pipe 2 particulate material passes out from the vessel via outlet 3.

Particulate material may be discharged through outlet 3 to a cyclone separator (not shown) for example whereby particulate material can be removed as product.

The dimensions of vessel 1 are chosen such that in operation the required resistance is provided.

I claim:

1. A process for the removal of a liquid from a particulate material having associated liquid which comprises forming a bed containing particulate material and associated liquid, passing gas upwardly via an inlet through the bed to take up liquid from the bed into the gas, removing gas and liquid taken up in the gas from the bed, withdrawing particulate material, from which liquid has been removed, from the bed via an outlet, below said gas inlet providing resistance to gas flow through the outlet so as to encourage gas to pass through the bed rather than through the outlet and transporting particulate material immediately after leaving the outlet by means of gas, said resistance to gas flow being provided by means of a packed bed of particulate material from which liquid has been removed prior to said particulate material being withdrawn from said outlet.

2. A process as claimed in claim 1 wherein the bed is formed in a vessel and the resistance to gas flow through the outlet is provided by a bed of particulate material positioned between the vessel and the outlet.

3. A process as claimed in claim 2 wherein particulate material from which liquid has been removed in the vessel is arranged to fall into a region below an inlet for the gas and form, in this region, a packed bed thereby to provide resistance to gas flow through the outlet and encourage gas to pass through a bed in the vessel rather than through the outlet.

4. A process as claimed in claim 1 wherein the bed is formed in a vessel and particulate material from which liquid has been removed is passed through the outlet and transported to a further vessel to form a second bed thereby to provide the resistance to gas flow through the outlet.

5. A process as claimed in claim 1 wherein the particulate material having associated liquid is a slurry containing substantially spherical particles.

6. A process as claimed in claim 5 wherein the substantially spherical particles are those produced by a gel precipitation process and the associated liquid is an agent used for drying gel particles.

7. A process as claimed in claim 1 wherein the gas is at a temperature higher than ambient temperature.

8. Apparatus for removing liquid from particulate material having associated liquid comprising a vessel for containing a bed of particulate material and associated liquid, means for passing gas upwardly via an inlet through such a bed when contained in the vessel such that liquid is taken up from the bed into the gas, means for removing gas and liquid taken up by the gas from the vessel, an outlet below said gas inlet for withdrawing particulate material, from which liquid has been removed, from the vessel, means for providing resistance to gas flow through the outlet so as to encourage gas to pass through the bed rather than through the outlet, said means for providing resistance comprising a means for forming a packed bed of particulate material from which liquid has been removed prior to said particulate material being withdrawn from said outlet and means for transporting particulate material immediately after leaving the outlet by gas.

9. Apparatus as claimed in claim 8 wherein the arrangement is such that particulate material from which liquid has been removed in the vessel may fall into a region below an inlet for the gas and form, in this region, a packed bed thereby to provide resistance to gas flow through the outlet and encourage gas to pass through a bed in the vessel rather than through the outlet.

10. Apparatus as claimed in claim 8 wherein the arrangement is such that particulate material from which liquid has been removed may pass through the outlet and be transported to a further vessel to form a second bed thereby to provide the resistance to gas flow through the outlet.

11. Apparatus as claimed in claim 8 wherein a gas ejector is provided for the transport of particulate material after leaving the outlet.

12. Apparatus as claimed in claim 8 comprising a column provided with a smaller diameter end portion, said end portion having an outlet for withdrawing particulate material and a gas inlet for introducing gas to the column, said column also being provided with a feed inlet, for introducing a slurry comprising particulate material and associated liquid to the column and a gas outlet, the arrangement being such that in operation particulate material, from which liquid has been removed in the column, may fall into the smaller diameter end portion to form a packed bed therein above the outlet thereby to provide resistance to gas flow through the outlet so as to encourage gas to pass through the column rather than through the outlet.

13. Apparatus as claimed in claim 12 wherein the smaller diameter end portion is provided with a further gas inlet to assist in start-up of the apparatus.

14. Apparatus as claimed in claim 8 comprising a column having an outlet for withdrawing particulate material from the column, a gas inlet for introducing gas to the column, a feed inlet for introducing a slurry comprising particulate material and associated liquid and a gas outlet, and, in communication with the column, a vessel for containing a bed of material thereby to provide resistance to gas flow through the outlet of the column so as to encourage gas to pass through the column rather than through the outlet, and an ejector pump for transporting particulate material from the outlet to the vessel.

15. Apparatus as claimed in claim 8 wherein an additional gas inlet is provided for fluidising a portion of a bed in the vessel.

* * * * *

UNITED STATES PATENT AND TRADEMARK OFFICE

CERTIFICATE OF CORRECTION

PATENT NO. : 4,475,292

DATED : Oct. 9, 1984

INVENTOR(S) : STOCKWELL, Claude, L.

It is certified that error appears in the above-identified patent and that said Letters Patent are hereby corrected as shown below: Item [73]:

On the cover page of the patent, upper left hand side, after "Assignee:" please delete "Secretary of State for United Kingdom Atomic Energy Authority, London, England" and substitute therefor --UNITED KINGDOM ATOMIC ENERGY AUTHORITY, London, England--.

Signed and Sealed this

*Fourteenth* Day of *May 1985*

[SEAL]

*Attest:*

DONALD J. QUIGG

*Attesting Officer*

*Acting Commissioner of Patents and Trademarks*